United States Patent [19]

Haff, Jr.

[11] 4,020,776

[45] May 3, 1977

[54] FEEDING AND CUTTING ATTACHMENT FOR SEWING MACHINES

[76] Inventor: Frederick Haff, Jr., 161 Tanners Pond Road, Garden City, N.Y. 11530

[22] Filed: Sept. 5, 1975

[21] Appl. No.: 610,660

[52] U.S. Cl. ..... 112/121.26; 112/130; 112/203

[51] Int. Cl.[2] ..... D05B 21/00

[58] Field of Search ..... 112/121.26, 121.27, 112/203, 205, 130, 152, 141, 136

[56] References Cited

UNITED STATES PATENTS

| | | | |
|---|---|---|---|
| 2,231,648 | 2/1941 | Weis | 112/121.26 |
| 3,011,460 | 12/1961 | Haff | 112/130 |
| 3,326,155 | 6/1967 | Paolicelli | 112/141 |
| 3,381,639 | 5/1968 | Miller | 112/130 |
| 3,680,509 | 8/1972 | Miller | 112/152 |

OTHER PUBLICATIONS

"New Elastic Feed-in Cut-off Attachment;" Southern Garment Manufacturer; Feb. 1975, pp. 30 & 31.

*Primary Examiner*—H. Hampton Hunter
*Attorney, Agent, or Firm*—Alexander Mencher

[57] ABSTRACT

Pivotally mounted attachment to a sewing machine feeding mechanism for intermittent elastic stripping applied to a base material during sewing operation and involving a substantially horizontal feed system to the sewing station. Said feeding mechanism is formed substantially of few and integrated parts with ready access for mounting and adjusting components. A laterally disposed cutting mechanism attachment is further utilized to cooperate with the feeding mechanism while a metering and/or tension mechanism are attached forwardly.

The feed, cutting and metering mechanism are structured for application thereto of power and switch control means for semi- or total automatic operation, the power means preferably being fluidic.

3 Claims, 10 Drawing Figures

FIG. 7
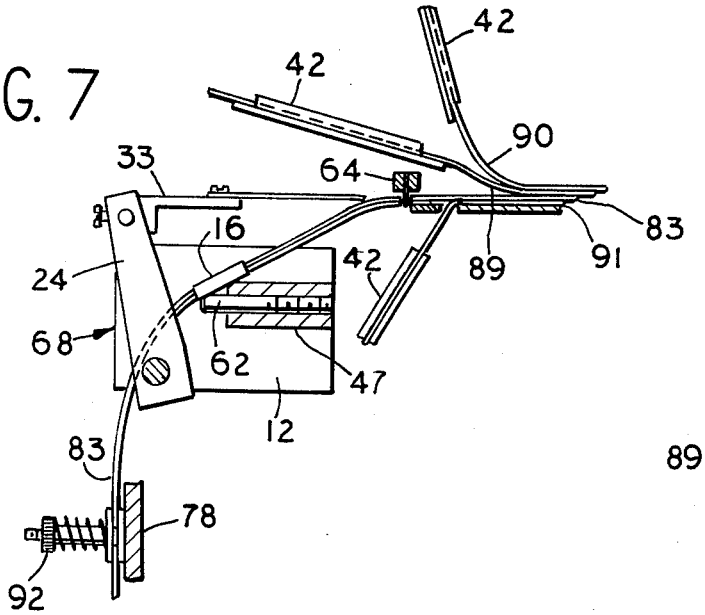
FIG. 8
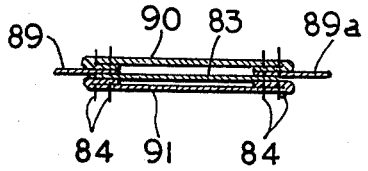
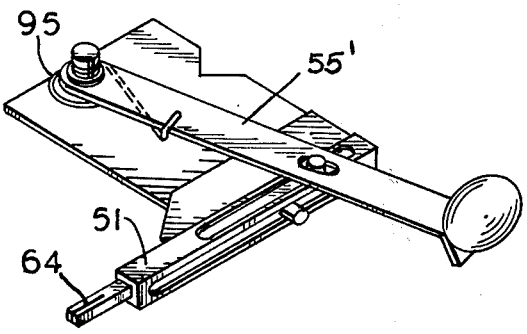
FIG. 9
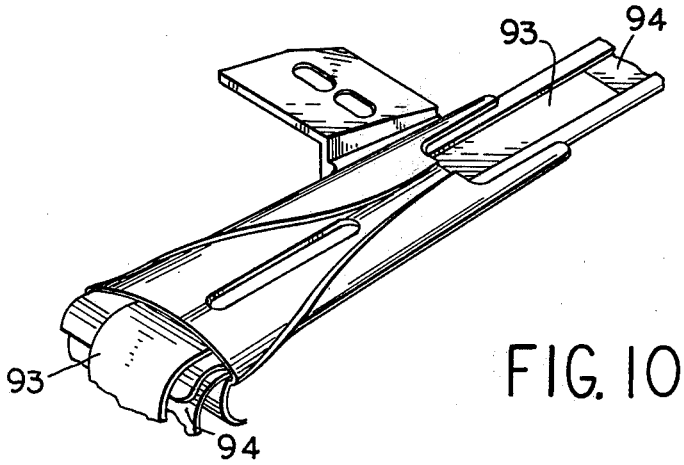
FIG. 10

FEEDING AND CUTTING ATTACHMENT FOR SEWING MACHINES

BACKGROUND OF THE INVENTION

Feeding and cutting devices for strips of material including elastic and adapted to be sewn to a base material as well as metering and/or tensioning devices are known to the art. Moreover, power means such as fluidic air systems (having stationary parts), pneumatic, electrical, electronic or other systems including components and circuitry thereof for operation of actuating means generally are also known in the art.

Prior art fails to show the combination of a novel feeding and compact feeding mechanism carried by a pivoted bracket and swingable away from the sewing station, with a cooperating cutting mechanism on a bracket fixed to the base or table of the machine. In conjunction with such combination, although metering and tensioning devices are common to the art, such devices as applied to the above stated combination are novel.

The structures are constructed for adaptation to use of power means for operation of the actuating devices and control means with fluidic air systems preferred.

Most pertinent prior art known to applicant consists of the following U.S. Pat. Nos. 3,011,460, Haff, Jr; 3,381,639, Miller; 3,680,509, Miller.

SUMMARY OF THE INVENTION

This invention relates to sewing machines and more particularly to industrial type sewing machines of the type used for large scale production.

The invention contemplates a feeding and cutting attachment for substantially horizontal feed of elastic stripping material adapted to be sewn to a base garment part with provision made for intermittent cutting of the elastic during the sewing operation to effectuate elastic gaps such as in sewing across the fly part of boxer gripper shorts, boys' dungarees, pajamas, and the like, or for other required purposes. An application for patent on overhead instead of said horizontal feed for related purposes submitted for filing contemporaneously with instant application and under title of Sewing Machine Feeding and Cutting Attachment for Elastic Stripping is herein identified under Ser. No. 610,687.

A main object of the invention resides in the provision of structure wherein a pivotal bracket lockably secured to the base or table of the machine carries the feeding mechanism for delivery of the elastic stripping and/or base materials to the sewing station. With this type of structure, swinging away of such mechanism enables the operator free access for threading and exposure for repairs and the like.

The feeding mechanism carried by such pivotal type of bracket operates in conjunction with a cutting mechanism affixed to the base or table of the machine and laterally disposed of the feeding mechanism.

The invention further utilizes a metering assembly adapted to be applied to the forward part of the bed of the machine or table for usual purposes. In a second embodiment, the metering device is substituted by a tensioning mechanism as will appear.

The invention is shown as adapted for semi-automatic operation as by use of a fluidic system with suitable switch controls (full automatic operation is also feasible, if and when required).

More particularly and in addition to the swingability of the feeding mechanism away from the sewing station, the feeding mechanism itself has novel and improved structure over my prior U.S. Pat. No. 3,011,460 in that parts and arrangements thereof are improved and more compacted.

Another object of the invention resides in the provision of apparatus which is compact, easy to apply and operate and efficient and economical in performance.

These objects and other incidental ends and advantages of the invention will hereinafter appear in the progress of the disclosure and as pointed out in the appended claims.

DRAWINGS OF EMBODIMENTS

In the drawings accompanying the specification:

FIG. 7 is a fragmentary cross-sectional view of a second embodiment of a tensioning device;

FIG. 8 is a cross-sectional view of a type of hem produced by the tensioning device of the second embodiment;

FIG. 9 is a view in perspective of another type of cutting assembly, adapted to be manually operated but applicable to semi-automatic operation with slight modification; and FIG. 10 is a view in perspective of another type of folder for the base and non-elastic material to which the elastic stripping is adapted to be sewed.

DESCRIPTION OF EMBODIMENTS OF INVENTION

The invention is presented as constituting several assemblies operatively connected and including the delivery or feed system, a cutting system, a metering or tensioning system and the power system.

PIVOTED AND INTEGRATED BASE PLATE AND BLOCK MOUNT FOR DELIVERY SYSTEM

Figure 1:
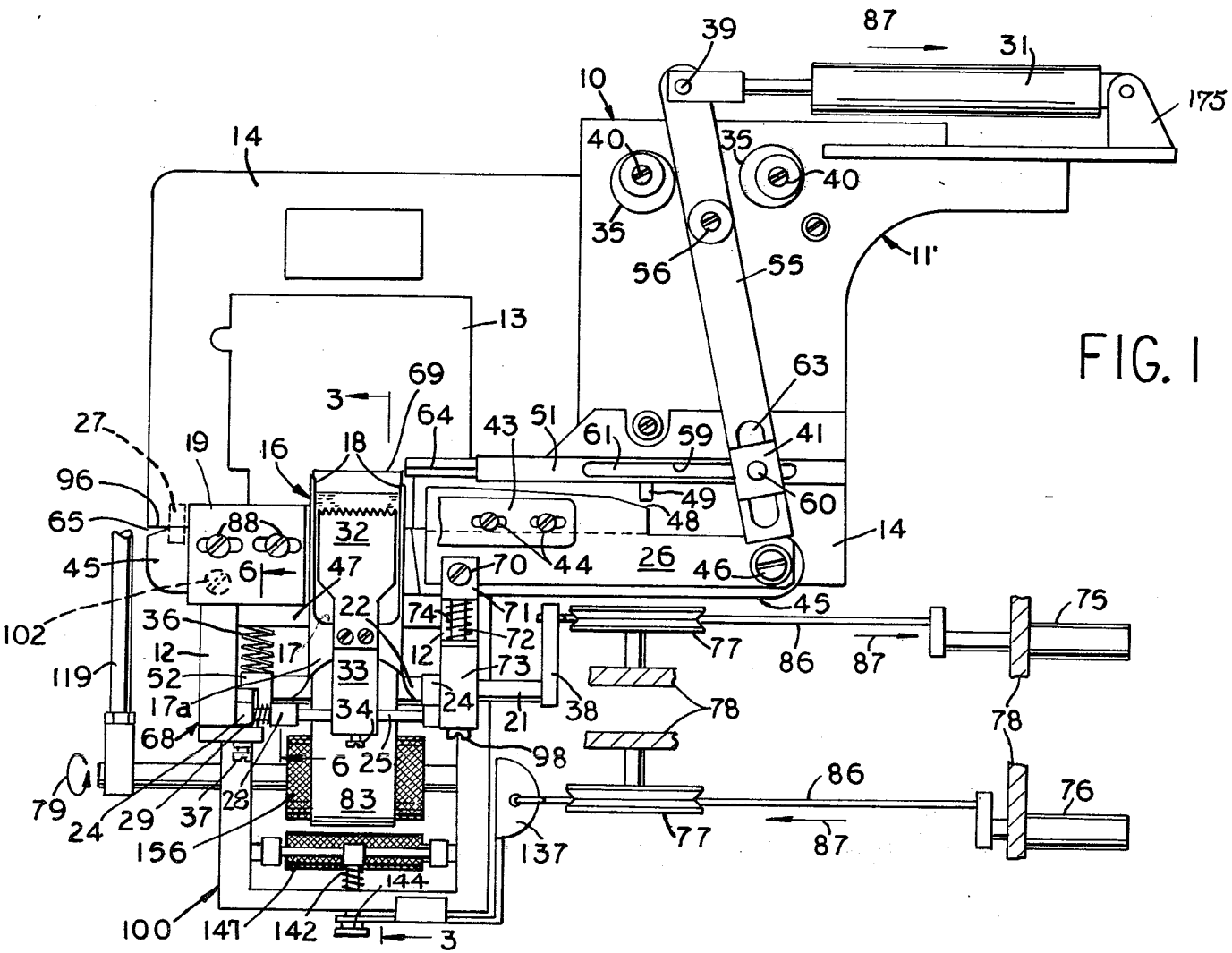
FIG. 1 is a plan view of the apparatus in rest position.
Figure 2:
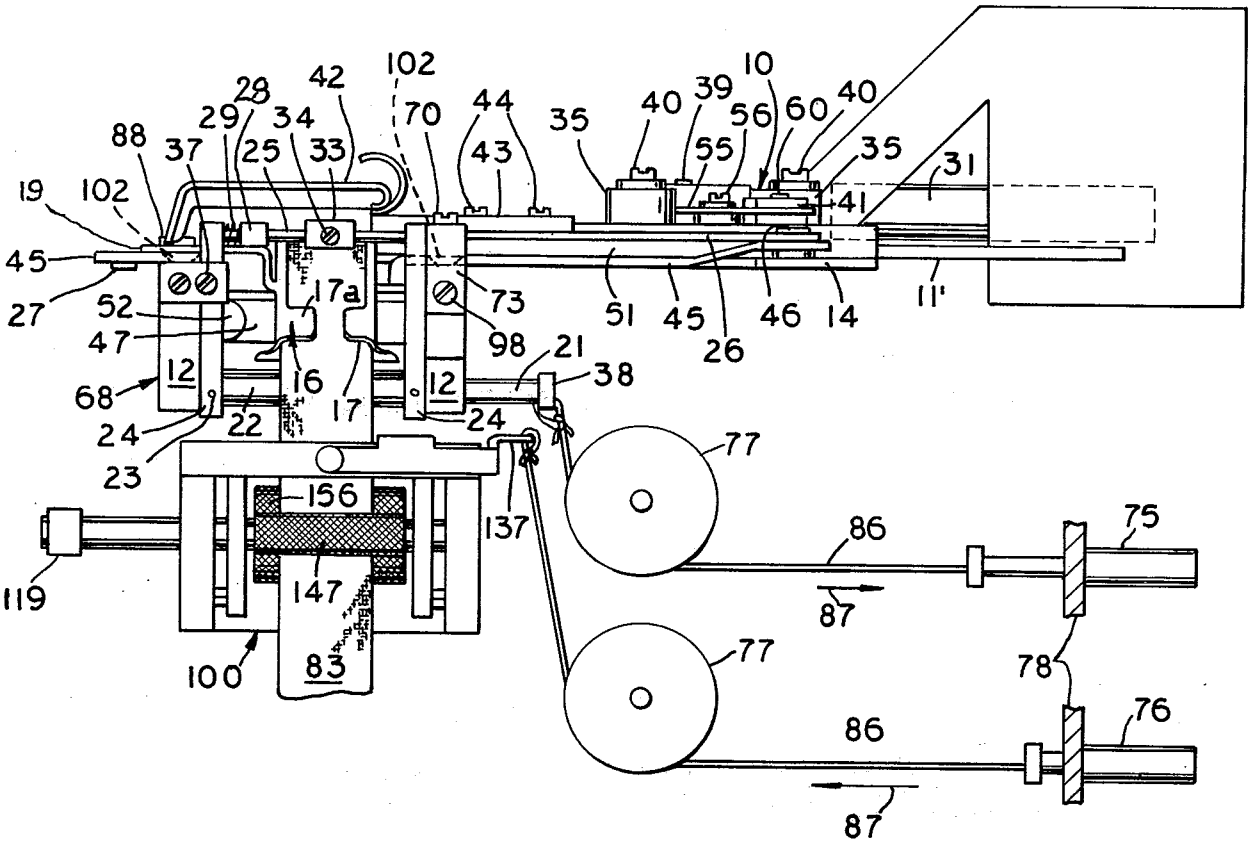
FIG. 2 is a front view in elevation with some parts partially shown.

The mounting structure and the feeding devices thereon are designated generally by numeral 68 as best illustrated in FIGS. 1 and 2. Thus, a base plate 45 is pivotally secured adjacent the outer end to the bed or table of the machine 14 as by pivot screw 46, and is provided at the other inner end and also in conjunction with machine bed or table 14 with a springlatch and catch such as 27 as at parting line 96. For release purposes, any tool may be applied at an offset portion 65 for releasing the connection between the machine bed and base phase plate 45 at such parting line.

Attached as by flange 19 to base plate 45 and proximate to the inner end is an arcuate guide plate or folder for elastic stripping 83 and is generally indicated by numeral 16. Said guide plate 16 is adapted to sit within a well or offset area of the base plate 45 and is laterally adjustable therein as by use of screws 88 in suitable notches of the flange 19.

Guide plate 16 has a transverse slot 17 formed by a bridging member 17*a* and adjacent to the inlet end thereof which opens toward a pair of inwardly extending guide flanges adjacent to the outer end of the guide plate and designated by numeral 18.

Elastic stripping 83 is adapted to be threaded upwardly through the slot 17, and through the guide flanges 18 toward the needles of the machine so as to be intermittently fed and stitched to the base material as will hereinafter be more fully described.

BLOCK STRUCTURE AND SUPPORTING FUNCTION

A mounting block formed of a pair of side plates 12 and an H-type connecting center member 47 is suitably secured to the underside of base plate 45 as at the tops of side plates 12 indicated by weld areas 102, the center or H-portion being positioned to straddle the well area of base plate 45 as seen in FIGS. 1 and 2. The said mounting block is preferably cast of aluminum for lightness in weight.

FEED FINGER AND ACTUATING MEANS THEREFOR

Actuating mechanisms for feed finger 32 for imparting longitudinal movement of stripping 83 from guide plate 16 to the sewing station is now to be described.

Block side plates 12 rotatably support a transversely extending rocker shaft 22 upon which a pair of rocker arms 24 are secured in spaced apart parallel relationship by means of associated set screws 23. Shaft 22 has an extension 21 carrying a lever 38 connected to actuating means for oscillating the rocker arm 24 as will appear. Rotatable connecting rod 25 extends between the free ends of the rocker arms 24. A bracket 28 serving to anchor one end of spring 29, the adjacent rocker arm 24 anchoring the other end is selectively secured at a predetermined point along the length of the rod 25 to bias the feed finger 32 against stripping 83 in the pathway of guide 16 for urging the stripping to the stitch-forming area as will appear.

Thus, the push type feed finger 32 is carried by a bracket 33 and is biased downwardly by spring 29 and is adjustably secured along the length of rod 25 by means of a set screw 34 and is adapted to initiate and move stripping 83 through the outlet end of guide plate 16 at the beginning of each elastic strip sewing operation.

Figure 3:
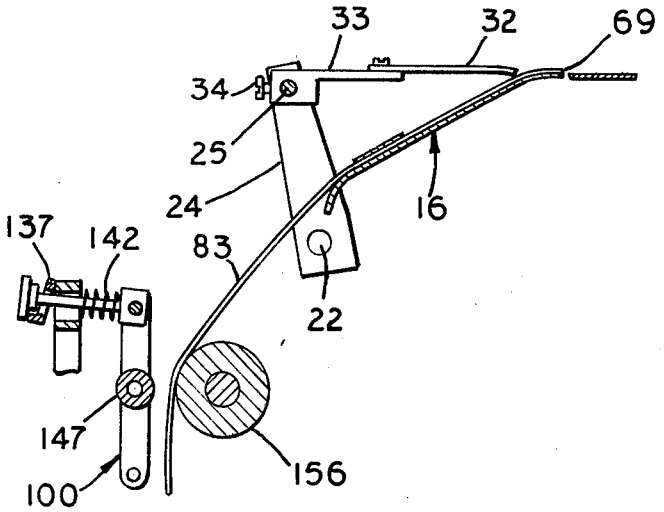
FIG. 3 is a fragmentary cross-sectional view taken along the line 3—3 of FIG. 1 in the rest position showing the metering or tensioning structure.

Feed finger 32 overlies the inlet end of the guide plate 16 so that upon forward movement thereof, the toothed portion will frictionally engage the adjacent portion of stripping 83 to urge same forwardly through the guide flanges 18 a predetermined distance and to enable the advanced portion to be picked up and sewed with the underlying base material, the latter being fed toward the stitch-forming area at needle plate 13 through a folder 42 (FIGS. 1, 2, and 3). Folder 42 as will appear is adjustably attached to a cam arm 26, the latter also being pivotally secured to the machine bed 14 by the same pivot screw 46 engaging base plate 45 (FIGS. 1 and 2).

Figure 6:
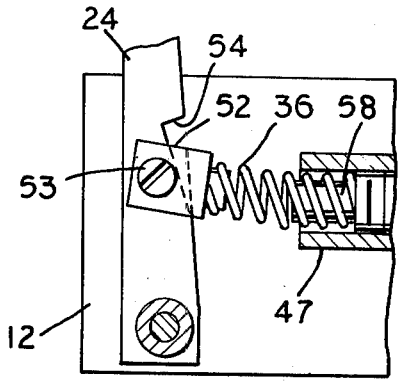
FIG. 6 is an enlarged detail and cross-sectional view taken along the line 6—6 of FIG. 1 showing novel biasing structure for the feed finger component of the delivery assembly.

A compression spring 36 normally resists forward movement of rocker arms 24 and operatively connected feed finger 32 and thus automatically returns the feed finger to the initial position after each stroke. Thus, by referring to FIG. 6, spring 36 at one end is supported by a retainer block 52 adapted to be pivoted as at 53 to rocker arm 24, the block travelling in rocker arm recess 54 as arm 24 advances. The central member 47 of the block formed with side plates 12 forms the mounting for the other end of spring 36. Such mounting involves a pin 58 threaded into the central member 47. By above arrangement, spring 36 is given more flexibility.

An adjustable set screw 37 carried by a bracket mounted upon one of the side plates limits the return movement of the rocker arm 24 so as to automatically position the working end of the feed finger 32 properly for the next operating cycle. Return movement of the rocker arms may also be effected as by use of an adjustable stop pin 62 shown in FIG. 7 and threaded into block central portion 47.

PIVOTAL CAM ARM

Cam arm 26 secured at one end thereof to the pivot screw 46 (in common with base plate 45) carries folder 42 by means of an adjustable bracket 43 and set screws 44.

A compression spring 74 urges cam arm 26 and the folder 42 carried thereby toward normal position as at rest. Spring 74 encircles a positioning pin 72 secured at one end to a mounting bracket 71 carried by the cam arm 26 as by screw 70, and at the other end to a member 73 secured to a side plate 12 as by screw 98.

The inside edge of cam arm 26 defines a cam surface 48 adapted to be engageable by a pin 49 of a cutting assembly for purposes of deflecting the folder 42 during the cutting cycle for elastic stripping as will appear.

CUTTING ASSEMBLY

A base plate 11' affixed to the bed or table of the machine carries at the longitudinal lower end a transverse and elongated cubical housing 51. Above mentioned pin 49 penetrates and travels along a housing slot (not shown), is secured to a knife block 61 that is slidable within the housing 51 for reciprocating longitudinal movement. Another pin 60 vertically disposed and also secured to the block 61 extends from another housing slot 59 in the top wall of housing 51. The slot for pin 49, it is to be observed, also travelling along housing 51 is in a side wall thereof. Operating pin 60 is also received within a short axial slot 63 at one end of an operating lever 55 and reciprocates therealong as by a riding block 41 having a blade 64 at the end thereof for cutting stripping 83 as will appear.

Lever 55 is suitably affixed to base plate 11' as at pivot screw 56 and is limited in motion during the cutting cycle as by adjustable stops in the form of spaced eccentrics 35 secured to base plate 11'. The outer end of lever arm 55 is adapted to have reciprocating actuating means secured thereto as by a suitable block pivoted at pin 39 as will appear.

MANUAL MODE OF OPERATION

The above feed delivery and cutting mechanisms thus far described are capable of successive manual operation as by first actuating the lever 55. Of course, lever 55 would have to be spring biased at 95 and a handle attached thereto as seen in FIG. 9. As shown, a modified handle 55' is biased and as at 95.

Figure 4:
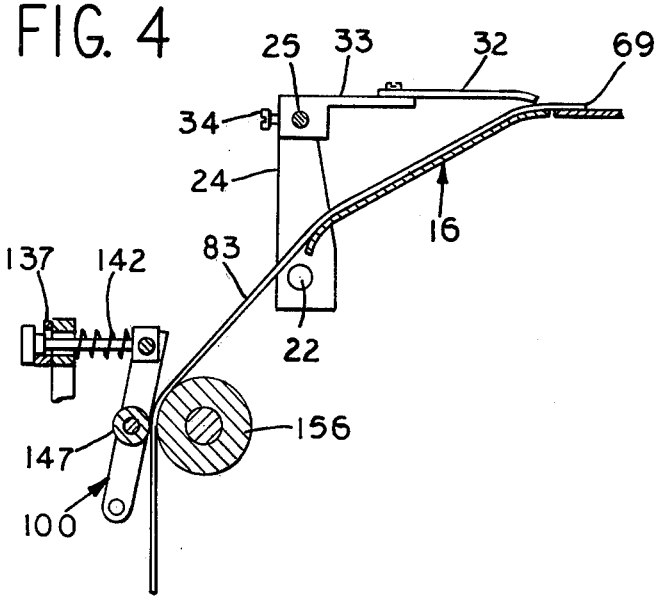
FIG. 4 is a fragmentary cross-sectional view along the line 3—3 of FIG. 1 showing the metering or tensioning structure in the active position.
Figure 5:
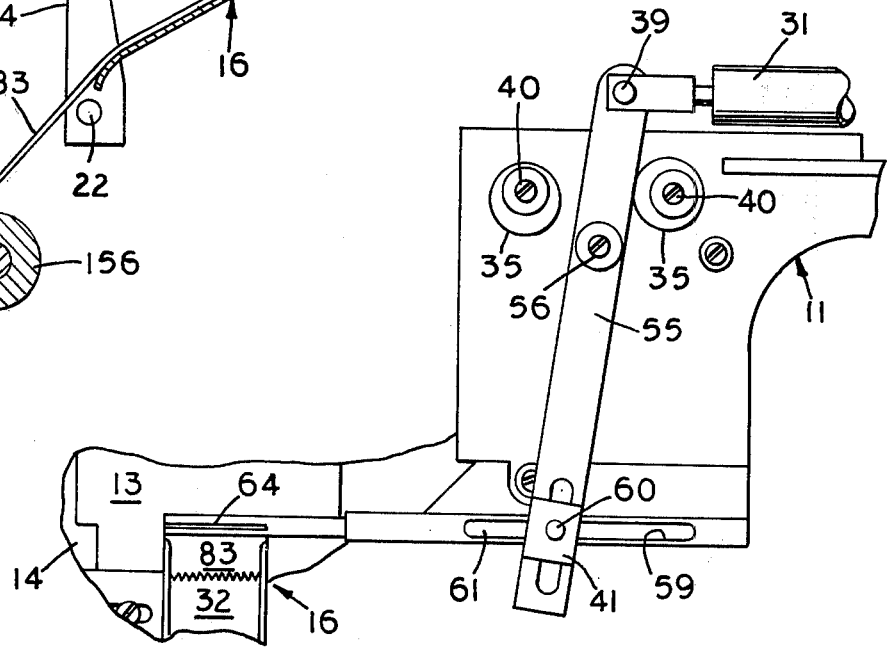
FIG. 5 is a fragmentary plan view showing the cutting blade of the cutting assembly in cutting position.

The subsequent operation of feed finger delivery when elastic stripping 83 is desired to be stitched to the base or garment material 81 is designed to advance feed finger 32 from the rest and engaging position shown in FIG. 3 as at the time of the cutting stroke shown in FIG. 5. Such advance of feed as shown in FIG. 4 would be accomplished by advancing lever or crank arm 38 forwardly against the action of compression spring 36. Thus movement of lever 55 will cause slide block 61 to move longitudinally toward strip guide plate 16. Simultaneously, block pin 49, against which cam arm 26 is biased as by spring 74 and which connects arm 26 to the base plate 45 in conjunction with common pivot screw 46, will engage the cam surface 48 of arm 26 so as to retract garment material folder 42 to an adjusted position out of the path of movement of slide block 61 as understood by reference to FIG. 5.

As mentioned, slide block 61 at the front end supports a blade 64 extending through the bottom housing 51 in direct alignment with the terminal edge 69 (FIG. 1) of the guide plate 16. As blade 64 traverses edge 69, elastic stripping 83 travelling along guide plate 16 is severed. When lever 55 is released by torsion spring 95 (FIG. 9), blade 64 and slide block 61 will be retracted and the material folder will be returned to normal position. At such time the end of the severed elastic stripping remaining within the guide plate 16 is ready for the next forward and feeding operation by feed finger 32.

AUTOMATIC OPERATION AND METERING DEVICE

Where actuating means for movement of lever 55 in the cutting assembly and movement of lever or crank 38 in the feed delivery assembly are powered by electrical, eletronic, pneumatic or other systems for automatic and semi-automatic operation, suitable equipment becomes applicable to the structures of the invention herein. In such event, metering and tensioning means are included for the usual reasons. Among such reasons is selective control of stretch during feed of the elastic material 83.

As shown in FIGS. 1, 2, 3, and 5, lever 55 has a fluidic air cylinder assembly 31 suitably attached to block pivot 39, while rocker or crank arm 38 has a fluidic air assembly 75 suitably attached thereto. A metering assembly generally indicated by numeral 100 (FIGS. 1 and 2) is also adapted to be power driven as by attachment thereto of a fluidic air cylinder assembly 76 by suitable connections. Air cylinder assemblies 75 and 76 at the outer ends are suitably affixed at convenient locations to the sewing machine as to supports 78 while cylinder assembly 31 is pivotally secured at the outer end to bracket 175 secured to base plate 11'.

Connections between fluidic air assemblies 75 and 76 are by such expedients as cables 86 and pulleys 77, the latter also being affixed to the sewing machine as to supports 78. One of the cables 86 is attached to lever or crank arm 38, and the other cable 86 is attached to a strip tension release lever 137 operative on the metering strip tension roller 147. The latter is associated with the feed roller 156 which is constantly rotating in the direction of arrow 79 and operated by a connecting rod 119 which is run off the sewing machine.

AUTOMATIC SEQUENTIAL OPERATIONS AND SWITCH CONTROLS

Operation of the fluidic sequences and of the mechanisms powered thereby now follows. The operator sews any length of elastic stripping 83 required at the start of sewing operations by a knee switch (not shown).

Prior to such activation, all mechanisms are in rest condition. Cylinder assembly 31 is in extended condition maintaining cutting blade in non-cutting position; cylinder 75 is in extended condition for maintaining rocker arm 24 in rearward position by compression spring 36; cylinder assembly 76 is in retracted condition creating a downward force on the tension release lever 137 thereby cocking the strip tension roller spring stud 146 thereby drawing back the strip tension roller 147 from engagement with the feed roller 156. Such disengagement makes inoperative the metering assembly even though feed roller 156 is rotating as stated in direction of arrow 79, and there is no movement of elastic stripping 83 as a consequence (FIG. 3).

For feed, the operator activates a suitable knee switch not shown while the above conditions prevail and the following is adapted to take place sequentially:

a. Cylinder assembly 76 goes into extended condition releasing compression of spring 142 and allowing it to extend thereby bringing tension strip roller 147 into contact with elastic stripping 83 against feed roller 156.
b. On the same pulse, cylinder assembly 75 goes into retracted condition pulling down lever or crank arm 38 thereby urging feed finger 32 forwardly and thereby carrying elastic stripping 83 into the stitch-forming area.
c. A second timed pulse returns cylinder assembly 75 and feed finger 32 to normal condition and position respectively.

The operator may now sew in as much elastic stripping 83 as is required.

On another successive activation of the knee switch for the cutting operation at any selected time during the sewing operation, the following takes place sequentially:

d. Cylinder assembly 31 operatively connected to slide block 61 is activated and goes into retracted condition effecting the cutting of elastic stripping (FIGS. 4 and 5).
e. A second pulse returns the slide block 61 to normal position by restoring original condition of the cylinder assembly.

Transmission of movement of operative parts of cylinder assemblies 75 and 76, as before mentioned, takes place through cables 86 and pulleys 77 which are attached to the sewing machine at convenient locations 78 and in the direction of initial action arrows 87.

AUTOMATIC OPERATION AND TENSIONING DEVICE

In a second embodiment of the invention as shown in FIG. 7, a spring loaded tensioner 92 (commercial part) is used in place of the metering assembly 100. One example of use thereof resides in the sewing of coverall jackets 89 to coverall trousers **89*a* with an upper band 90 and sections of elastic stripping 83 intermittently applied within the waist band and a lower band 91**.

Since the metering device 100 is not used in the second embodiment, the time sequence is suitably changed to accommodate for elimination of cylinder assembly 76 and its associated parts. From FIG. 7, elastic stripping 83 is carried through the tensioner 92 and up through guide plate 16. With use of different types of folders all being designated by numeral 42, the configuration as shown in FIG. 8 may be obtained.

Folders of all types and requirements when used in conjunction with the improvements herein give sewing machines capability of producing a large variation in finished products. One folder as shown in FIG. 10 carries a live rubber stripping 93 with a knit material 94 that is folded over the rubber at the exit area. This folder could replace the guide plate 16 in certain operations.

It is understood that the improvements herein are adapted for both manual, automatic and semi-automatic operation. Moreover, although the invention herein has been described with particular reference to the construction shown in the drawings, it is to be understood that such is not to be construed as imparting limitations upon the invention, which is best defined by the claims appended hereto.

I claim:

1. In apparatus for use with a sewing machine to intermittently apply strips of elastic material to a base material and having stitch-forming means and work-feeding means for feeding the materials to be sewed past the stitch-forming means during continuing sewing operation, the improvement which comprises: a mounting block, a feed finger and operatively connected rocking means therefor secured to said block, a substantially horizontal bracket plate having an intermediate pocket and to which plate said block is attached, a stud secured to the sewing machine for pivotally mounting the said bracket plate at one end, means between said bracket plate and other end of the sewing machine for releasably affixing said bracket plate to said machine, a guide plate secured in the pocket of said bracket plate, actuating means secured to said bracket plate and operatively connected to said rocking means to effect elastic strip feed along said guide plate to the stitch-forming area, a second bracket plate affixed to the sewing machine, reciprocable cutting means mounted on said second bracket and adapted to sever the elastic strip between said guide plate and stitch-forming area, second actuating means secured to said second bracket and operatively connected to said cutting means, a cam arm and folder for said base material carried thereby and pivotally mounted on said stud at one end, said cam arm having means for springable connections to said block at the other end of the cam arm, said cutting means having a stud operative on said cam arm to deflect said folder from the cutting path of said cutting means, each activation of the first actuating means for the rocker means and each activation of the second actuating means for the cutting means being successive for consecutive feed and cutting of the elastic strip.

2. In apparatus as set forth in claim 1 having metering and tensioning means to deliver said elastic stripping to said guide plate, said metering means comprising a constantly rotating driven roller disposed forwardly of said sewing machine, and said tensioning means comprising an adjustable tension roller engagable with said driven roller and operable thereby for tensioning said elastic strip.

3. In apparatus for use in a sewing machine to intermittently apply strips of elastic material to a base material and having stitch-forming means and work-feeding means for feeding the materials to be sewed past the stitch-forming means during continued sewing operation, the improvement which comprises: a mounting block, feed delivery and actuating means therefor secured to said block, a stud affixed to the machine and a bracket plate at one end pivotally secured thereto, means between said bracket plate at the other end and said machine for releably affixing said bracket plate to the machine and for carrying said block, cutting means and actuating means therefor, a second bracket plate affixed to said machine and to which said cutting and actuating means are mounted, and a cam arm and a folder for said base material carried thereby and pivotally mounted on said stud, said cam arm having means for springable connection to said block at the other end of said cam arm, said cutting means having a stud operative on said cam arm to deflect said folder from the cutting path of said cutter means.

* * * * *